United States Patent [19]

Shimazaki et al.

[11] 4,249,496

[45] Feb. 10, 1981

[54] AIR-FUEL RATIO FEEDBACK CONTROL APPARATUS OF AN INTERNAL COMBUSTION ENGINE

[75] Inventors: Ryuji Shimazaki, Susono; Yoji Satoh, Nagoya, both of Japan

[73] Assignees: Toyota Jidosha Kogyo Kabushiki Kaisha; Nippon Soken, Inc., both of Aichi, Japan

[21] Appl. No.: 965,848

[22] Filed: Dec. 4, 1978

[30] Foreign Application Priority Data

Dec. 12, 1977 [JP] Japan ..... 52-148208

[51] Int. Cl.[3] ..... F02B 3/00

[52] U.S. Cl. ..... 123/438; 123/440; 123/439

[58] Field of Search ..... 123/119 EC, 32 EE, 32 EA; 60/276, 285

[56] References Cited

U.S. PATENT DOCUMENTS

| | | | |
|---|---|---|---|
| 3,882,829 | 5/1975 | Sasaki | 123/32 EA |
| 3,890,938 | 6/1975 | Oishi et al. | 123/32 EA |
| 3,890,946 | 6/1975 | Wahl | 123/119 R X |
| 4,009,697 | 3/1977 | Chateau | 123/32 EA |
| 4,020,802 | 5/1977 | Hattori et al. | 123/32 EA |
| 4,027,637 | 6/1977 | Aono | 123/119 EC |
| 4,030,292 | 6/1977 | Masaki et al. | 123/119 EC |
| 4,040,394 | 8/1977 | Wahl et al. | 123/119 EC |
| 4,040,408 | 8/1977 | Krams et al. | 123/32 EE |
| 4,106,448 | 8/1978 | Noguchi et al. | 60/285 |
| 4,145,999 | 3/1979 | Aoki | 123/32 EE |
| 4,153,014 | 5/1979 | Savaet | 123/32 EA |
| 4,156,413 | 5/1979 | Taplin | 123/32 EA |

*Primary Examiner*—Charles J. Myhre
*Assistant Examiner*—R. A. Nelli
*Attorney, Agent, or Firm*—Stevens, Davis, Miller & Mosher

[57] ABSTRACT

An air-fuel ratio feedback control apparatus of an internal combustion engine in which an air-fuel ratio of an air-fuel mixture is at first set on the lean side of the desired air-fuel ratio. Additional fuel is supplied from at least one fuel injection valve. The amount of injected fuel each time the injecting operation is carried out is increased or decreased by a certain quantity in accordance with an air-fuel ratio condition signal detected by an air-fuel ratio sensor. Only when the air-fuel ratio feedback, control operation is initiated, then is a large amount of fuel abruptly supplied to the engine by an auxiliary fuel control means. Thereafter, the normal injecting operation is carried out together with the operation for increasing or decreasing the amount of injected fuel by a certain quantity.

20 Claims, 14 Drawing Figures

UP-DOWN COUNTER
U/D
CL
C2 Q1 Q2 Q3 Q4
P1 P2 P3 P4 PE
Co
R
+Vc
MAGNITUDE COMPARATOR
B1 B2 B3 B4
A1 A2 A3 A4
+Vcc
BINARY COUNTER
R' Q1' Q2' Q3' Q4'
CL'
CLOCK PULSE GENERATOR
(A)
(B)
(C)
(D)
(E)
(F)
16a
18a
20
21
22
23
24
25
26
27
28
29
30
31
32
33
34

AIR-FUEL RATIO FEEDBACK CONTROL APPARATUS OF AN INTERNAL COMBUSTION ENGINE

BACKGROUND OF THE INVENTION

The present invention relates to an air-fuel ratio control apparatus of an internal combustion engine. More particularly, the invention relates to an air-fuel ratio feedback control apparatus in which an air-fuel mixture having a base air-fuel ratio on the lean side of the desired air-fuel ratio is formed by a carburetor or the like disposed in an intake system of the engine and then the air-fuel ratio of the air-fuel mixture is controlled to the desired value by controlling the amount of fuel additionally supplied via at least one fuel injection valve disposed in the intake system, in accordance with an air-fuel ratio condition signal fed from an air-fuel ratio sensor, such as an oxygen concentration sensor, disposed in an exhaust system of the engine.

In conventional air-fuel ratio control apparatuses of this type, the air-fuel ratio control is performed by increasing or decreasing the amount of fuel additionally supplied from fuel injection valves by a certain quantity each time an injecting operation is carried out, based on a detection signal of an air-fuel ratio sensor. In this case, if the quantity of the fuel increased or decreased each time of the injecting operation is increased, the time required for obtaining the desired air-fuel ratio can be shortened, but after obtaining the desired air-fuel ratio, the amplitude variation of the air-fuel ratio is relatively large and it is very difficult to maintain the air-fuel ratio within a predetermined range approximating to and including the desired air-fuel ratio. Accordingly, the quantity of the fuel increased or decreased on each occurrence of the injecting operation is adjusted so that the amplitude variation of the air-fuel ratio is within the above-mentioned predetermined range. However, this method is defective in that a long time period from the start of the feedback control is required for obtaining the desired air-fuel ratio. Generally, in internal combustion engines of this type, a three-way catalytic converter capable of simultaneously purifying three pollutant components, HC, CO and $NO_x$, is disposed in an exhaust system, and in order to maintain the purifying efficiency of this three-way catalytic converter at the highest level, the air-fuel ratio condition of an exhaust gas is controlled within a predetermined range. Accordingly, if the air-fuel ratio is on the lean side and such ratio is not controlled in a short time within the predetermined range even by starting the feedback control, pollutants of the exhaust gas, especially $NO_x$, can not be purified; therefore, a problem concerning the legal regulation of emission is caused. Further, when an exhaust gas recirculation apparatus (EGR apparatus) is used in combination with the conventional air-fuel ratio control apparatus, if the air-fuel ratio does not reach the desired value but remains on the lean side, a problem is caused, in the operability of the engine, for example, the accelerability thereof, is extremely degraded.

SUMMARY OF THE INVENTION

It is, therefore, an object of the present invention to provide an air-fuel ratio feedback control apparatus of an internal combustion engine, whereby the time from initiation of the feedback control required for obtaining the desired air-fuel ratio can be shortened without causing any negative effect on the amplitude variation of the controlled air-fuel ratio after the desired value is obtained.

In accordance with the present invention, an air-fuel ratio feedback control apparatus of an internal combustion engine comprises: means for providing the engine with an air-fuel mixture having an air-fuel ratio on the lean side of the desired air-fuel ratio; means for increasing or decreasing the amount of an additional fuel fed into the engine via at least one fuel injection valve, by a certain quantity each time the injecting operation of the fuel injection valve is carried out, wherein the above-mentioned increasing operation or the above-mentioned decreasing operation is selected in accordance with the level of an air-fuel condition signal fed from an air-fuel ratio sensor disposed in an exhaust system of the engine; and, means for abruptly increasing the amount of fuel fed into the engine when the air-fuel ratio feedback control operation is initiated.

The above-mentioned and other related objects and features of the present invention will be apparent from the following description of the present invention with reference to the accompanying drawings, as well as from the appended claims.

DETAILED DESCRIPTION OF THE INVENTION

Figure 1:
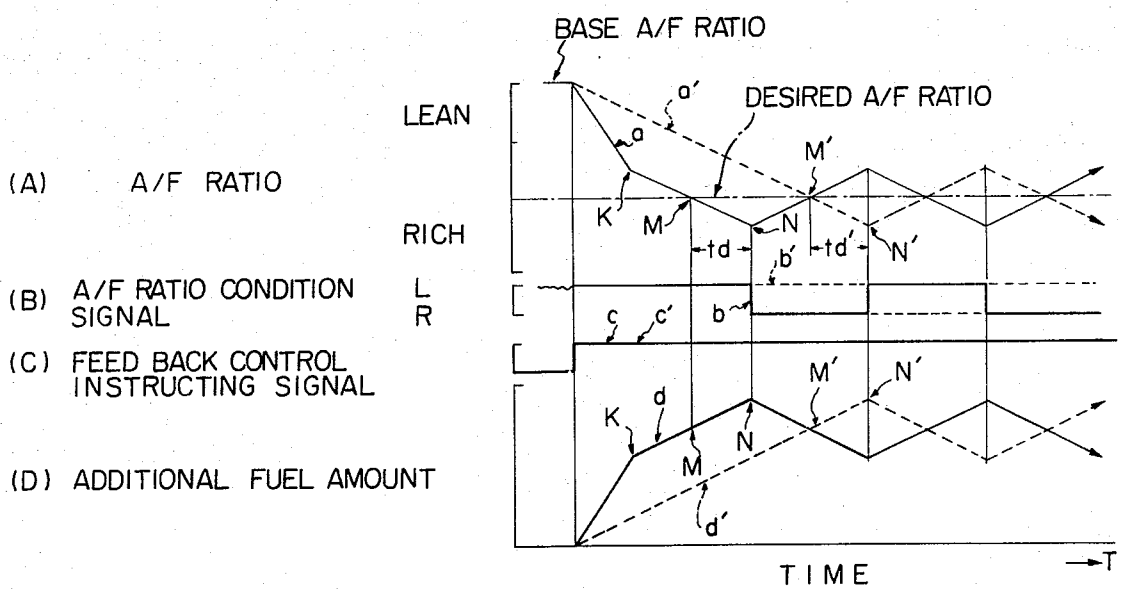
FIG. 1 is a characteristic diagram illustrating the basic concept of the present invention.

FIG. 1 illustrates (A) the air-fuel ratio (A/F ratio) characteristic, (B) the characteristic of the detection signal (air-fuel ratio condition signal) provided from an air-fuel ratio sensor, (C) the characteristic of the detection signal from an operating condition sensor which detects the operating conditions for starting the air-fuel ratio feedback control, for example, the vacuum level in an intake pipe, and (D) the characteristic of the amount of an additional fuel in the apparatus of the present invention and the conventional apparatus. In FIG. 1, the abscissa indicates time, solid lines show the characteristics (A) through (D) of the apparatus of the present invention and broken lines show those of the conventional apparatus.

In the conventional apparatus, under operating conditions where the feedback control of the air-fuel ratio is not required, for example, under operating conditions where a throttle valve is closed, in other words, the signal c' (FIG. 1-(c)) from the operating condition sensor is at a low level, the feedback control of the air-fuel ratio is not effected and therefore, the air-fuel ratio a' (FIG. 1-(A)) is equal to the base air-fuel ratio. Namely, the air-fuel ratio a' is on the lean side. When the throttle valve is opened and the output signal of the operating condition sensor is raised to a high level, the feedback control of the airfuel ratio is initiated. In this case, the detection signal b' FIG. 1-(B) from the air-fuel ratio sensor is a high level signal L indicating that the air-fuel ratio is on the lean side of the desired air-fuel ratio (hereinafter referred to as a "lean signal"), and therefore, the amount of the fuel fed into the engine is gradually increased and the air-fuel ratio a' is gradually shifted toward the rich side. When the air-fuel ratio of the air-fuel mixture in the intake system of the engine arrives at the point M' (FIG. 1-(A)), a desired air-fuel ratio is achieved, but the detection signal b' of the air-fuel ratio sensor is not changed to a low level signal R indicating that the air-fuel ratio is on the rich side of the desired, air-fuel ratio (hereinafter referred to as "rich signal"). The detection signal b' changes to the rich signal for the first time at a point N' (FIG. 1-(A)) which point N' is later than the point M' with a certain response time delay td' (FIG. 1-(A)) corresponding to the sum of the time delay owing to flowing of the fluid between the additional fuel supply mechanism located in the intake system of the engine and the air-fuel ratio sensor located in the exhaust system of the engine and the time delay of detection in the air-fuel ratio sensor. Accordingly, at this point N', the amount of the additional fuel d' (FIG. 1-(D)) fed into the engine is decreased and the air-fuel ratio is shifted toward the lean side. Then the increasing operation and the decreasing operation of the constant amount of fuel are alternatively repeated in the foregoing manner.

In the apparatus of the present invention, when the detection signal c (FIG. 1-(C)) of the operating condition sensor is raised to a high level and the feedback control is initiated, since the detection signal b (FIG. 1-(B)) from the air-fuel ratio sensor is a lean signal, the amount d (FIG. 1-(D)) of the additional fuel fed into the engine is abruptly increased, whereby the air-fuel ratio a (FIG. 1-(A)) is abruptly brought close to the desired value. This abrupt increase of the amount of the additional fuel is stopped at a point K (FIG. 1-(D)), and then, the amount of the additional fuel is gradually increased in the same manner as in the conventional apparatus. In FIG. 1, this point K is located before a point M (FIG. 1-(A), (D)) where the air-fuel ratio arrives at the desired value. However, in the apparatus of the present invention, the position of the point K is not particularly critical as long as the point K is located before the point N (FIG. 1-(A), (D)) where the detection signal b of the air-fuel ratio sensor is changed to the rich signal from the lean signal. Of course, a desirable air-fuel ratio control effect can be attained as the point K is set at a position where the air-fuel ratio a is closer to the desired value.

The present invention will be desired in detail with reference to various embodiments.

Figure 2:
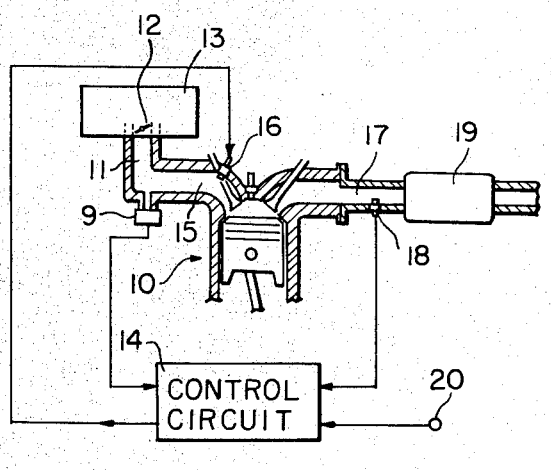
FIG. 2 is a schematic diagram of an internal combustion engine to which an air-fuel ratio feedback control apparatus according to the present invention is applied.

Referring to FIG. 2 reference numeral 10 represents an engine body. A carburetor 13 equipped with a throttle valve 12 is disposed on the top end of an intake pipe 11 of the engine. This carburetor 13 comprises a base air-fuel ratio setting mechanism for forming an air-fuel mixture having an air-fuel ratio on the lean side of the desired air-fuel ratio. A vacuum sensor 9 is mounted, as the operating condition sensor, on the intake pipe 11 downstream of the throttle valve 12 so that when the throttle valve 12 is opened, the vacuum sensor 9 generates a detection signal and feeds the signal to a control circuit 14 described hereinafter. A known throttle position switch may be used instead of this vacuum sensor 9. A fuel injection valve 16 for each cylinder is disposed on an intake manifold 15 of the engine. The fuel injection valve 16 injects a fuel fed from a fuel supply mechanism (not shown) into the intake manifold 15 in response to a valve-opening signal fed from the control circuit 14. in some embodiments of the present invention, one fuel injection valve 16 may be used for all of the cylinders in the assembling portion of the intake manifold 15.

An air-fuel ratio sensor 18, such as an oxygen concentration sensor for detecting the oxygen concentration in the exhaust gas, is disposed in an exhaust pipe 17 of the engine. This air-fuel ratio sensor 18 provides a detection signal to the control circuit 14. A three-way catalytic converter 19 for simultaneously purifying HC, CO and $NO_x$ is disposed on the exhaust pipe 17 downstream of the air-fuel ratio sensor 18. Disposed in the control circuit 14 is an input terminal 20 connected to an ignition circuit (not shown) of the engine, to which an ignition signal developed across a primary winding of an ignition coil disposed in the ignition circuit is applied.

Figure 3:
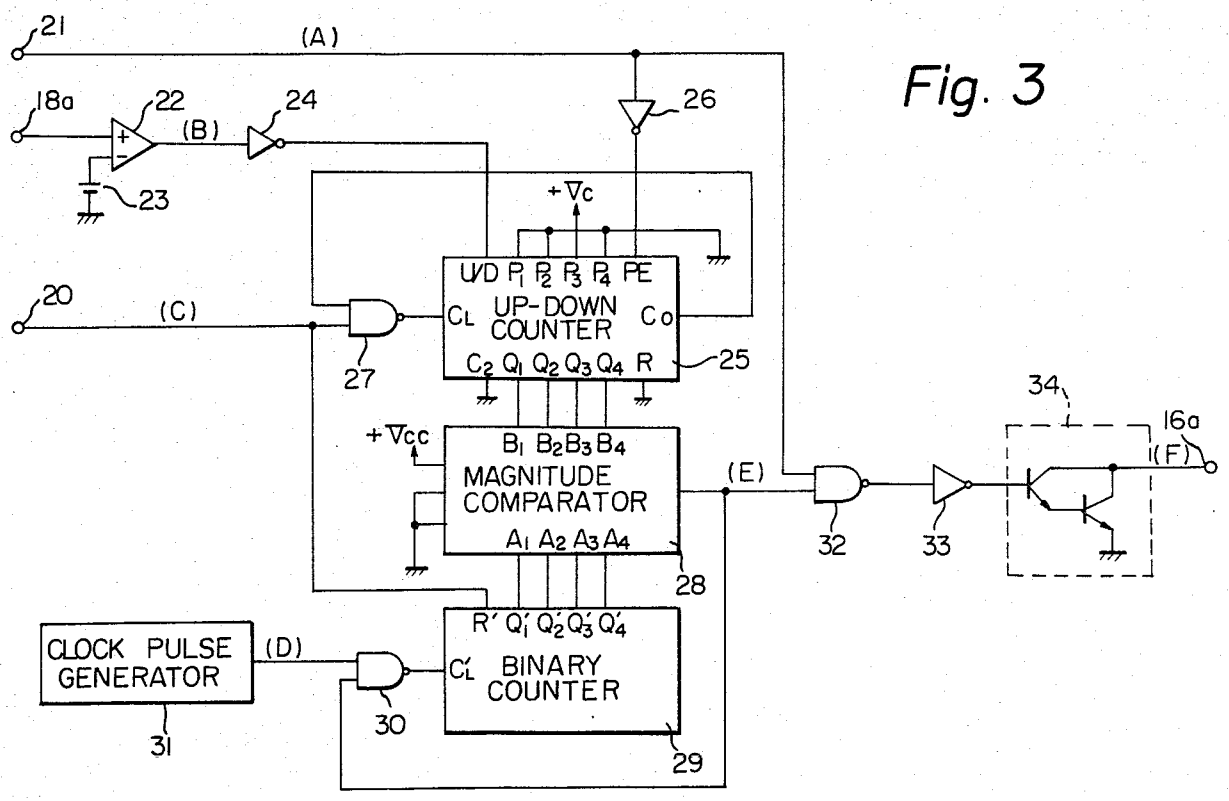
FIG. 3 is a schematic block diagram of a control circuit used in an embodiment according to the present invention.

FIG. 3 is a block diagram illustrating the structure of the control circuit 14 in one embodiment of the present invention.

Referring to FIG. 3, reference numeral 21 represents an input terminal connected to the above-mentioned vacuum sensor 9, 20 an input terminal connected to the ignition circuit of the engine, **18*a* an input terminal connected to the air-fuel ratio sensor 18,. and reference numeral 16*a* represents an output terminal connected to an exciting coil (not shown) of the fuel injection valve 16. The input terminal 18*a* is connected to a non-inverting input terminal of an operational amplifier constituting a comparator 22, and a reference voltage source 23 is connected to an inverting input terminal of the operational amplifier. Accordingly, when a lean signal is fed from the air-fuel ratio sensor 18, the level of the output signal of the comparator 22, namely, the air-fuel ratio condition signal (shown in FIG. 4-(B)), becomes low, and when the rich signal is fed from the air-fuel ratio sensor 18, then the level of this output signal of the comparator 22 becomes high. This air-fuel ratio condition signal is applied to an up-down control terminal U/D of a presettable up-down counter 25 through a NOT circuit 24. The up-down counter 25 is controlled so that when the level of the air-fuel ratio condition signal is low, namely, when the lean signal is fed from the air-fuel ratio sensor 18, the up-down counter 25 performs a count-up operation, and when the level of air-fuel ratio condition signal is high namely, when the rich signal is fed from the air-fuel ratio sensor 18, the up-down counter 25** performs a count-down operation.

Preset input terminals $P_1$, $P_2$, $P_3$ and $P_4$ of the up-down counter 25 are arranged so that voltages of a predetermined fixed level are applied thereto. Presetting of the initial value is effected when the level of the inverted detection signal of the vacuum sensor 9 applied from the input terminal 21 through the NOT circuit 26 is changed to a high level. When the throttle valve 12 opens, the level of the detection signal of the vacuum sensor 9, i.e., the feedback control instructing signal, becomes high, and when the throttle valve 12 closes, the level of the detection signal of the vacuum sensor 9 becomes low. Accordingly, the above-mentioned presetting is effected when the throttle valve 12 is closed. The initial value to be preset is adjusted to a sufficiently larger than the incremental or decremental value of the up-down counter 25, for example, about "0100".

Figure 4:
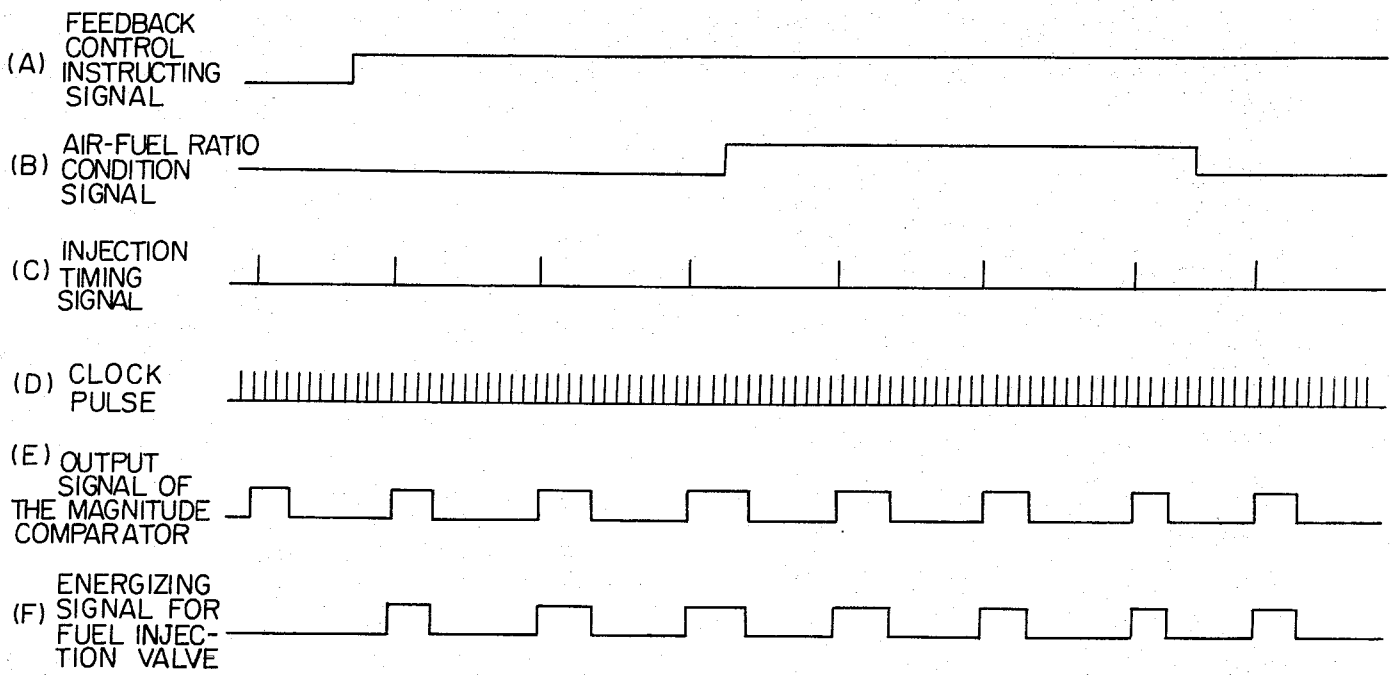
FIG. 4 shows waveforms obtained at various points in the control circuit shown in FIG. 3.

The increment or decrement of the up-down counter 25 is effected by an ignition signal fed from the ignition circuit, i.e., the injection timing signal (shown in FIG. 4-(C)), applied to a clock terminal $C_L$ through the input terminal 20 and a NAND circuit 27. Output terminals $Q_1$, $Q_2$, $Q_3$ and $Q_4$ of the up-down counter 25 are connected to one group of input terminals $B_1$, $B_2$, $B_3$ and $B_4$ of a magnitude comparator 28, respectively. The other group of input terminals $A_1$, $A_2$, $A_3$ and $A_4$ of the magnitude comparator 28 are connected to output terminals $Q'_1$, $Q'_2$, $Q'_3$ and $Q'_4$ of a binary counter 29, respectively. The binary counter 29 is arranged so that the counter 29 is reset by the injection timing signal and the counter 29 is counted up by clock pulses, shown in FIG. 4-(D), applied from a clock pulse generator 31 through a NAND circuit 30. The magnitude comparator 28 generates a high level signal when the output of the up-down counter 25 is larger than the output of the binary counter 29 as shown in FIG. 4-(E). Such output signal of the magnitude comparator 28 is applied to a driving circuit 34 for driving the fuel injection valve 16, through a NAND circuit 32 and a NOT circuit 33. The driving circuit 34 is a known TTL circuit, and as pointed out hereinbefore, the output terminal of the driving circuit 34 is connected to the exciting coil of the fuel injection valve 16 through an output terminal 16*a*.

The NAND circuit 32 is "on-off" controlled by the high and low levels of the above-mentioned feedback control instructing signal, and the NAND circuit 30 is "on-off" controlled by the high and low levels of the output signal of the magnitude comparator 28. Accordingly, when the value of the output signal of the binary counter 29 exceeds the value of the output signal of the up-down counter 25, no clock pulse is applied to the binary counter 29 and the binary counter 29 does not perform the counting operation until it is reset by the subsequent injection timing signal. The NAND circuit 27 is used so that while the up-down counter 25 is executing the presetting operation, no clock pulse is applied to the up-down counter 25.

Figure 5:
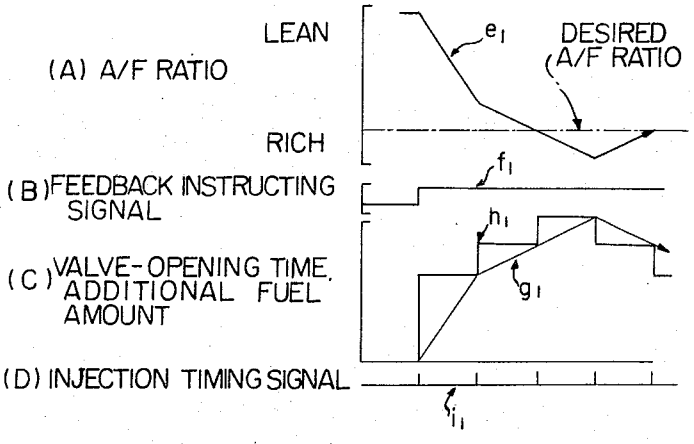
FIG. 5 shows characteristic diagrams illustrating the operation of the embodiment shown in FIG. 3.

The operation of the present embodiment will now be described with reference to the waveform diagrams of FIG. 4 and characteristic diagrams of FIG. 5. In FIG. 5, (A) shows the air-fuel ratio (A/F ratio) of an air-fuel mixture fed into the combustion chambers of the engine, (B) shows the feedback control instructing signal, (C) shows the valve-opening time of the fuel injection valve and the amount of the additional fuel, and (D) shows the injection timing signal. In these diagrams, the abscissa indicates time.

When the throttle valve 12 is closed, the level of the feedback control instructing signal as indicated by $f_1$ in FIG. 5-(B) is low, and therefore, the NAND circuit 32 is closed and the fuel injection valve 16 is not energized. During this period, data of the above-mentioned fixed initial value is present in the up-down counter 25. When the throttle valve 12 is opened and the level of the feedback control instructing signal is caused to be high, the NAND circuit 32 is opened and the output signal of the magnitude comparator 28 is applied to the driving circuit 34 to energize the injection valve 16. The time of energization, i.e., the valve-opening time, corresponds to the time during which the binary counter 29 counts a number of clock pulses the same as the value of the output signal of the up-down counter 25. Namely, the valve-opening time is proportional to the value of the output signal of the up-down counter 25. The value of the output signal of the up-down counter 25 is selectively increased or decreased by a binary number of 1, according to the level of the air-fuel ratio signal, every time the injection timing signal indicated by $i_1$ in FIG. 5-(D) is applied. Since a relatively large fixed value is preset in the up-down counter 25, the first valve-opening time at the start of the feedback control is of a relatively large value, as indicated by $h_1$ in FIG. 5-(C). Accordingly, the amount of additional fuel supplied from the fuel injection valve 16 is abruptly increased at the start of the feedback control, as indicated by $g_1$ in FIG. 5-(C), and the degree of the subsequent increase or decrease of the amount of the additional fuel is reduced. Therefore, the air-fuel ratio comes close to the desired air-fuel ratio in a short time from initiation of the feedback control, as indicated by $e_1$ in FIG. 5-(A), and then, the air-fuel ratio is controlled and converged within a predetermined range approximating to and including the desired air-fuel ratio.

Figure 6:
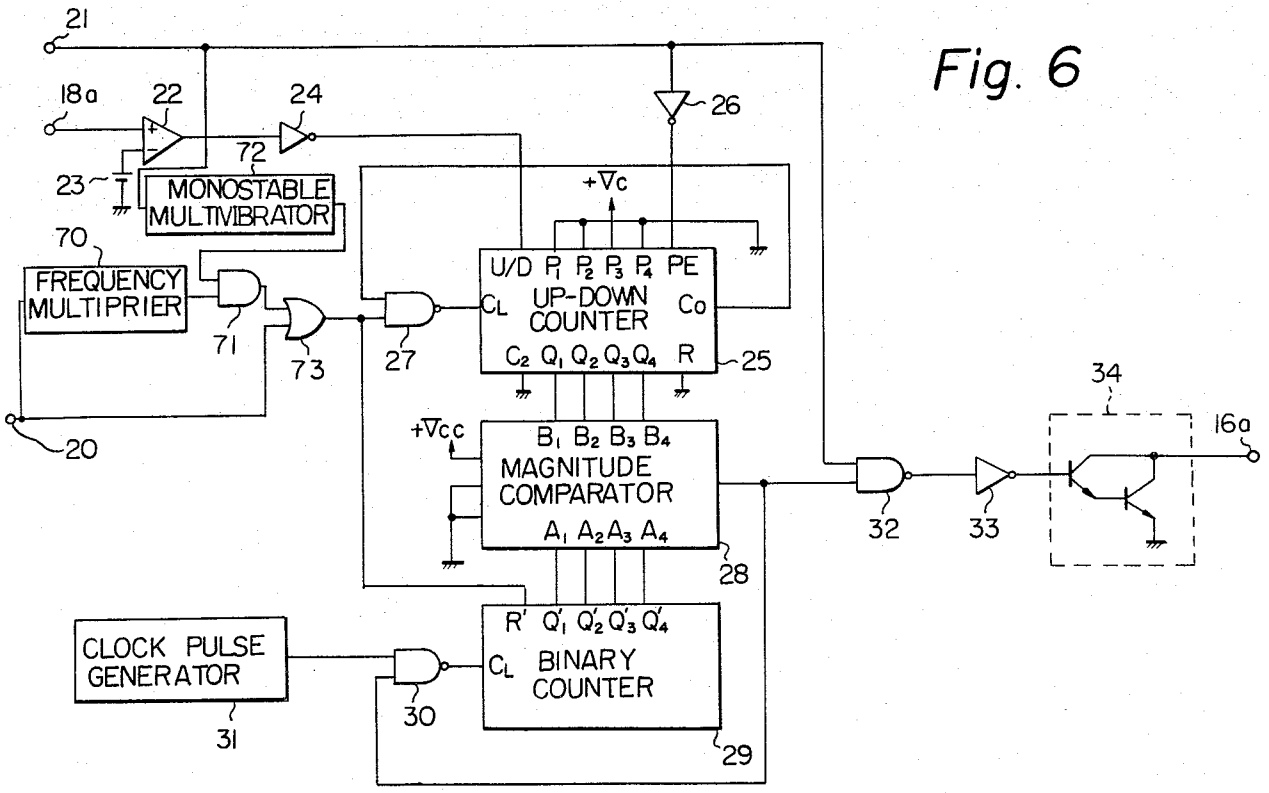
FIG. 6 is a schematic block diagram of a control circuit used in another embodiment according to the present invention.

FIG. 6 is a block diagram showing the structure of the control circuit 14 in another embodiment of the present invention.

The circuit structure shown in FIG. 6 is substantially the same as the circuit structure shown in FIG. 3 except for the portion for forming the injection timing signal. More specifically, an input terminal of a frequency multiplier 70 for multiplying, for example, triplicating, the frequency of the ignition signal fed from the ignition circuit via the input terminal 20 is connected to the input terminal 20, and the output terminal of this frequency multiplier 70 is connected to one input terminal of an AND circuit 71. The other input terminal of the AND circuit 71 is connected to an output terminal of a monostable multivibrator 72 to be triggered by the positive edge of the feedback control instructing signal applied from the input terminal 21. An output terminal of the AND circuit 71 is connected to one input terminal of an OR circuit 73, and the other input terminal of the OR circuit 73 is connected to the input terminal 20. An output terminal of the OR circuit 73 is connected to the NAND circuit 27 and to a reset terminal R' of the binary counter 29.

In the above-mentioned circuit structure, a period of the injection timing signal is shortened until a predetermined time period corresponding to the pulse duration of the monostable multivibrator 72 is passed since the feedback control instructing signal is applied. For example, a period of the injection timing signal is shortened to $\frac{1}{3}$ of the normal period therof.

Figure 7:
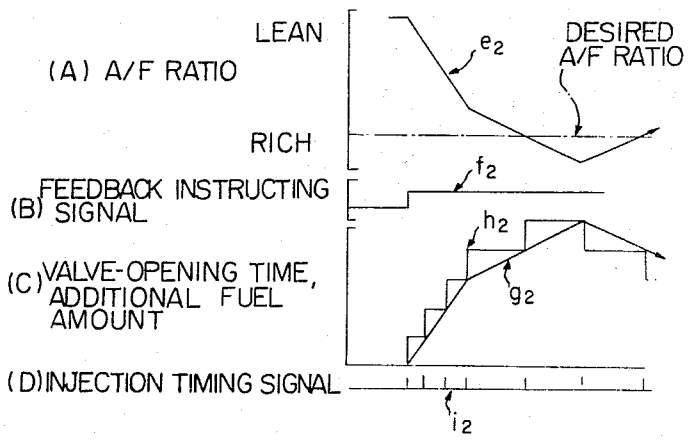
FIG. 7 shows characteristic diagrams illustrating the operation of the embodiment shown in FIG. 6.

FIG. 7 illustrates characteristics of (A) the air-fuel ratio, (B) the feedback control instructing signal (C) the valve-opening time of the fuel injection valve and the amount of the additional fuel and (D) the injection timing signal in the embodiment illustrated in FIG. 6. As will be apparent from the diagrams of FIG. 7, in the present embodiment, as indicated by $h_2$ in FIG. 7-(C) and $i_2$ in FIG. 7-(D), the degree of increase of the valve-opening time for every injecting operation of the fuel injection valve is always kept constant while the injection interval is shortened only for a predetermined time after initiation of the feedback control by increasing the frequency of the injection timing signal $i_2$. As a result, the quantity of the additional fuel is abruptly increased during initiation of the feedback control as indicated by $g_2$ in FIG. 7-(C), and then, the degree of increase or decrease of the amount of fuel is reduced.

Figure 8:
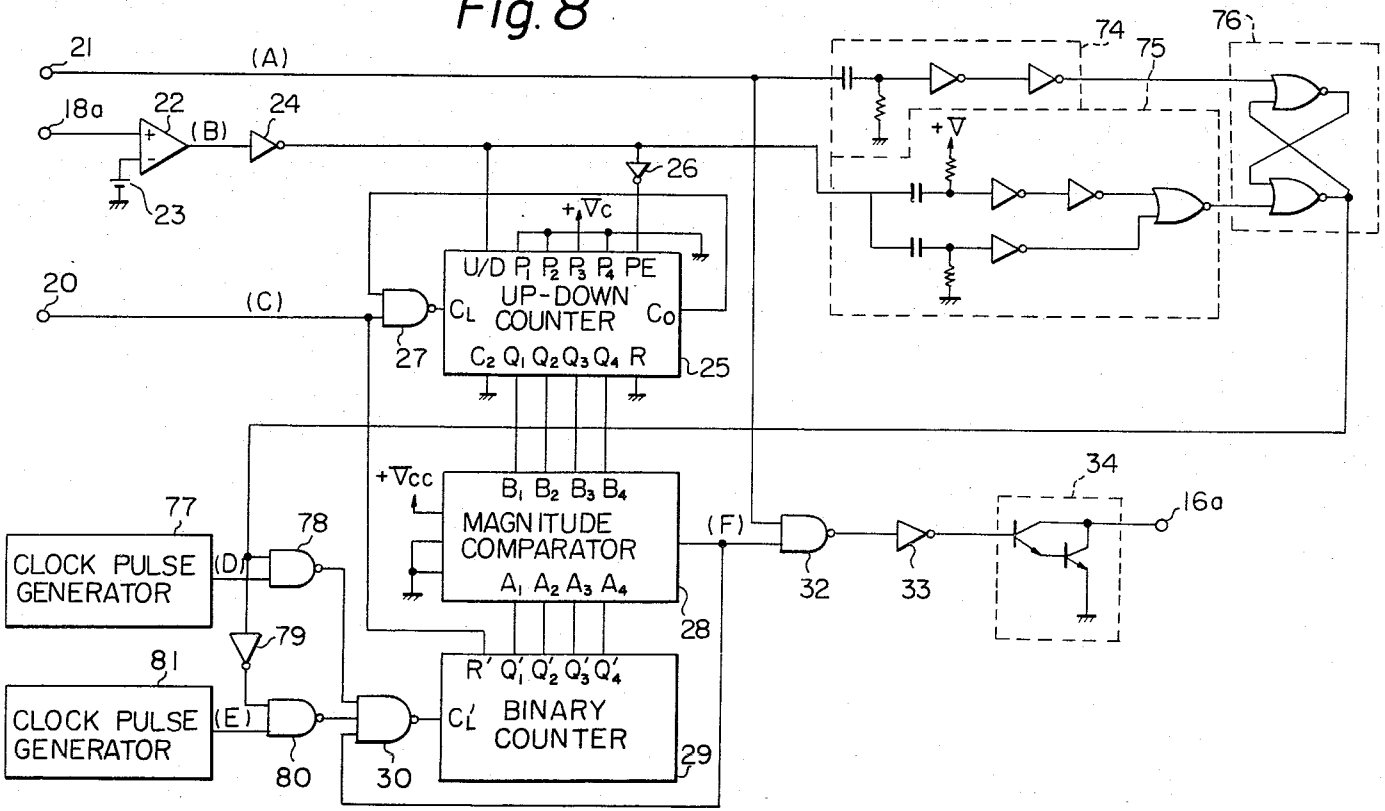
FIG. 8 is a schematic block diagram of a control circuit used in a third embodiment according to the present invention.

FIG. 8 is a block diagram showing the structure of the control circuit 14 of the third embodiment of the present invention.

The circuit structure of this embodiment is fundamentally identical with the structure shown in FIG. 3, but is different from the structure of FIG. 3 in that in this embodiment, two clock pulse generators are so disposed and selecting circuits are so mounted that output pulses of these generator are appropriately selected. More specifically, in the circuit shown in FIG. 8, the input terminal 21 is connected to a set terminal of an R-S flip-flop 76 through a pulse generating ciurcuit 74 for generating a pulse at the positive edge of the feedback control instructing signal applied from the input terminal 21. The output terminal of the NOT circuit 24 is connected to, a reset terminal of the flip-flop 76 through another pulse generating circuit 75 for generating pulses at both the negative and positive edges of the air-fuel ratio condition signal fed from the comparator 22. The output terminal Q of the flip-flop 76 is connected to one input terminal of NAND circuit 80 through one input terminal of a NAND circuit 78 having the other input terminal connected to a first clock pulse generator 77 and through a NOT circuit 79. The other input terminal of the NAND circuit 80 is connected to the output terminal of a second clock pulse generator 81, and the output terminals of the NAND circuits 78 and 80 are connected to two input terminals of the NAND circuit 30, respectively. The frequency of the clock pulse of the first clock pulse generator 77 is adjusted to a value smaller than the frequency of the clock pulse of the second clock pulse generator 81 (for example, a value adjusted to a value of $\frac{1}{4}$ of the clock pulse frequency of the second clock pulse generator 81).

Figure 9:
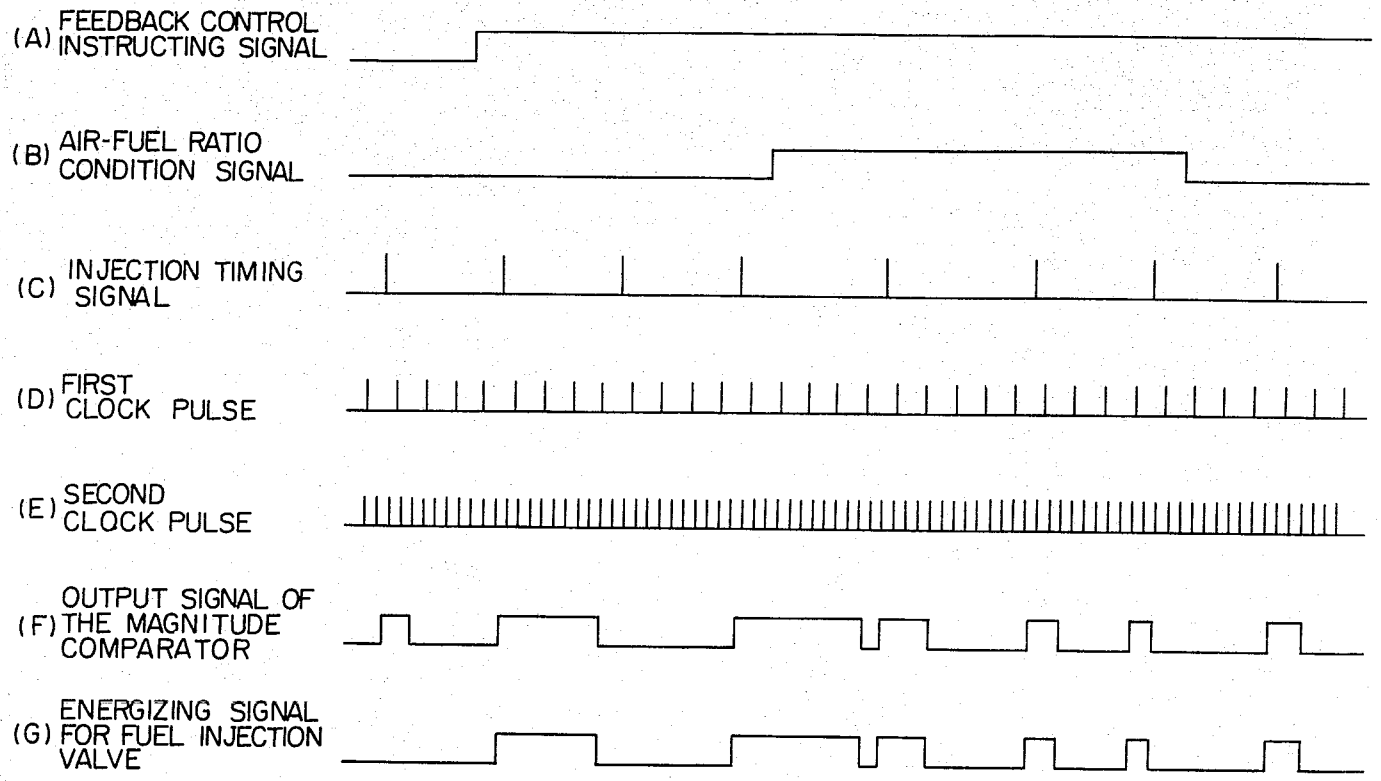
FIG. 9 shows waveforms obtained at various points in the control circuit shown in FIG. 8.

FIG. 9 is a wave form diagram illustrating the operation of the embodiment shown in FIG. 8. When a high level feedback control instructing signal (shown in FIG. 9-(A)) is applied to the input terminal 21, since the flip-flop 76 is set, an output of the first clock pulse generator 77, namely, a first clock pulse shown in FIG. 9-(D), is applied to the clock input terminal $C_L'$ of the binary counter 29. Then, when the level of the air-fuel ratio condition signal shown in FIG. 9-(B), fed from the air-fuel ratio sensor 18 is inverted, the output of the second clock pulse generator 81, namely, second clock pulse shown in FIG. 9-(E), is applied to the clock input terminal $C_L'$ of the binary counter 29. Accordingly, in the present embodiment, the valve-opening time is long during the period from the start of the feedback control to the first inversion of the air-fuel ratio condition signal level as described herinafter, and this time is shortened after this period.

Figure 10:
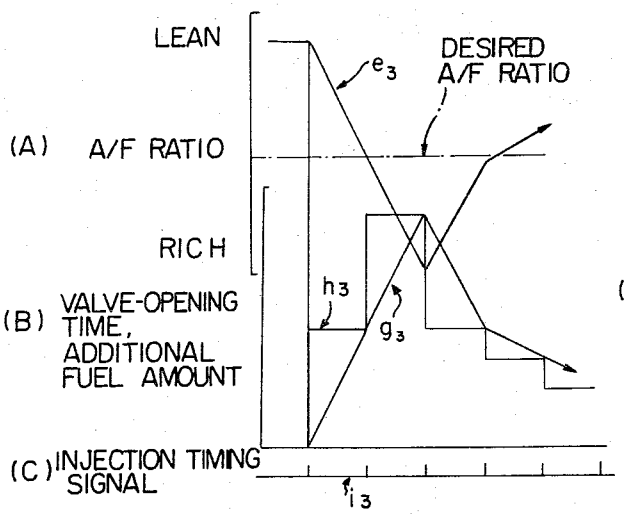
FIG. 10 shows characteristic diagrams illustrating the operation of the embodiment shown in FIG. 8.

FIG. 10 illustrates characteristics of (A) the air-fuel raito, (B) the valve-opening time of the fuel injection valve and the amount of the additional fuel and (C) the injection timing signal of the embodiment shown in FIG. 8. In this embodiment, the injection interval of the fuel injection valve is always constant as indicated by $i_3$ in FIG. 10-(C), but the valve-opening time is long during the period from the start of the feedback control to the point when the air-fuel ratio is changed to the rich side of the desired air-fuel ratio as shown by $h_3$ in FIG. 10-(B). Accordingly, when the feedback control is initiated, the amount of the additional fuel is abruptly increased as indicated by $g_3$ in FIG. 10-(B), and the air-fuel ratio is allowed to reach the desired value in a short time as indicated by $e_3$ in FIG. 10-(A). Then, the valve-opening time is shortened to an ordinary valve-opening time. Therefore, the degree of increase or decrease of the amount of the additional fuel is reduced, and the air-fuel ratio is controlled and converged within a predetermined range approximating to and including the desired air-fuel ratio.

Figure 11:
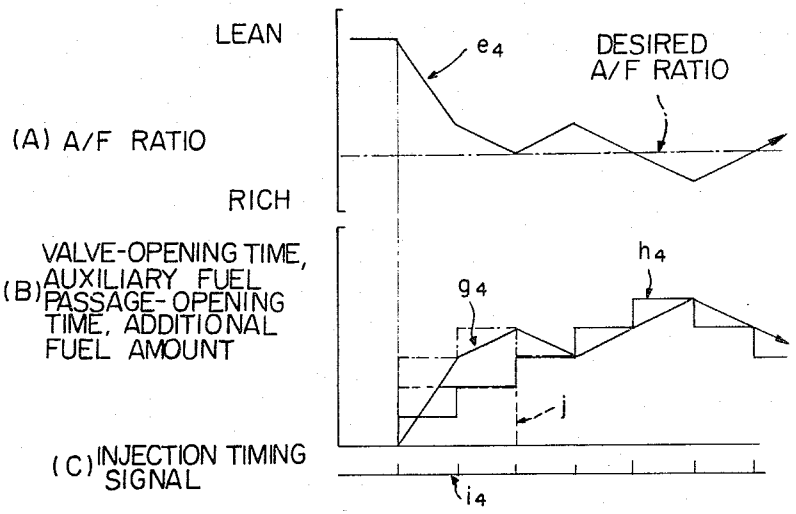
FIG. 11 shows characteristic diagrams illustrating the operation of the fourth and fifth embodiments shown in FIGS. 12 and 13, respectively.

FIG. 11 illustrates characteristics of (A) the air-fuel ratio, (B) the valve-opening time of the fuel injection valve, the opening time of the auxiliary fuel passage for increasing the amount of fuel and the amount of the additional fuel and (C) the injection timing signal of the fourth and fifth embodiments of the present invention. In FIG. 11-(B), $h_4$ illustrates the characteristic of the valve-opening time of the fuel injection valve, and this characteristic is set, as in the conventional technique, so that the fuel injection valve is actuated each time a predetermined interval is passed for a predetermined injecting time period from initiation of the feedback control. In FIG. 11-(B), j illustrates the passage-opening time characteristic of an auxiliary fuel supply means which is different from the fuel injection valve, namely, an auxiliary fuel passage disposed in the carburetor portion to increase the amount of fuel. In these embodiments, during initiation of the feedback control, fuel is additionally supplied from this auxiliary fuel passage. Furthermore, the fuel is supplied in a certain increased or decreased amount from the fuel injection valve each time of injection operation as in the conventional technique. Accordingly, the amount of fuel is abruptly increased during initiation of the feedback control as indicated by $g_4$ in FIG. 11-(B), and then the degree of increase or decrease of the fuel amount is reduced.

Figure 12:
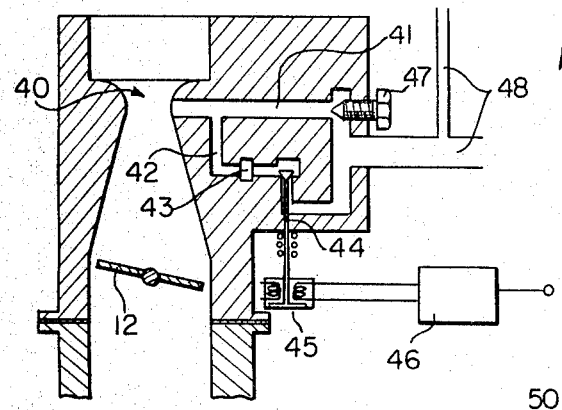
FIGS. 12 and 13 are cross-sectional diagrams of carburetor portions of the fourth and fifth embodiments according to the present invention, respectively.
Figure 13:
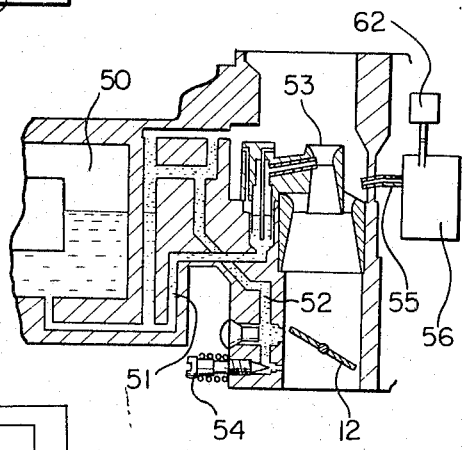
Figure 14:
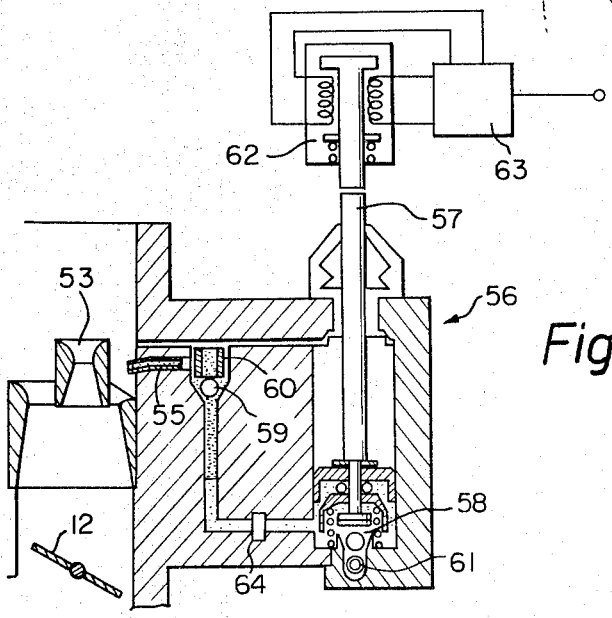
FIG. 14 is a partially enlarged sectional diagram of FIG. 13.

FIGS. 12 to 14 are diagrams illustrating the structure of the above-mentioned auxiliary fuel supply means. FIG. 12 shows carburetor in the fourth embodiment of the present invention. This carburetor includes the auxiliary fuel supply means which is employed when a fuel exhibiting its own fuel pressure, for example, LPG, is used. In FIG. 12, reference numeral 40 represents a venturi portion of the carburetor, 41 a main fuel passage, 42 the above-mentioned auxiliary fuel passage for increasing the amount of fuel, 43 a jet which determines cross-sectional area of the auxiliary fuel passage 42, 44 a power valve for supplying the additional fuel to the auxiliary fuel passage 42, 45 an electromagnetic mechanism connected to the power valve 44 to open or close the power valve 44, and reference numerals 46 represents an electronic circuit including a driving circuit for driving the electromagnetic mechanism 45 and a monostable multivibrator. This electronic circuit 46 triggers the monostable multivibrator when the level of the feedback control instructing signal rises from a low level to a high level, and generates a signal energizing the electromagnetic mechanism 45 only during the period corresponding to the output pulse duration of the monostable multivibrator. Therefore, only during this energizing period is the fuel additionally jetted into the venturi portion to increase the amount of fuel. As a result, the characteristics as shown in FIG. 11 can be obtained. Incidentally, in FIG. 12, reference numeral 47 represents a flow control valve for the main fuel passage, and reference numeral 48 represents main and slow fuel passages.

FIGS. 13 and 14 illustrate a carburetor in the fifth embodiment of the present invention. This carburetor is employed when a fuel which does not have its own fuel pressure, such as gasoline, is used, and also illustrate an auxiliary fuel supply means attached to the carburetor. In FIGS. 13 and 14, reference numeral 50 represents a float chamber, 51 a main fuel passage, 52 a slow fuel passage, 53 a small venturi, 54 an idling adjusting screw, 55 a nozzle for jetting an additional fuel for increasing the amount of the fuel, 56 a pump for compressing an additional fuel for increasing the amount of fuel, 57 a pump plunger, 58 and 59 steel balls, 60 a discharge weight, 61 an auxiliary fuel passage from the float chamber 50, 62 an electromagnetic mechanism, 63 an electronic circuit, and reference numeral 64 represents a jet which determines the cross sectional area of the auxiliary fuel passage for supplying an additional fuel for increasing the amount of fuel. The electromagnetic mechanism 62 and electronic circuit 63 have the same structures and also perform the same function as those of the above-mentioned electromagnetic mechanism 45 and electronic circuit 46. In the fourth embodiment shown in FIG. 12, the electromagnetic mechanism 45 actuates the power valve 44, but in this fifth embodiment, the electromagnetic mechanism 62 actuates the pump plunger 57. When this pump plunger 57 is pressed, the fuel in a pump cylinder into which the plunger is inserted is compressed and both the steel ball 59 and discharge weight 60 are brought up, whereby the additional fuel is jetted from the nozzle 55 to the venturi portion for increasing the amount of fuel while the amount of fuel to be jetted is being adjusted by the auxiliary fuel passage. Thus, the characteristics shown in FIG. 11 can be obtained.

As will be apparent from the foregoing illustration, in the air-fuel ratio feedback control apparatus of the present invention, since a means is provided for abruptly increasing the amount of fuel only during initiation of the feedback control of the air-fuel ratio, the air-fuel ratio can be controlled to the desired air-fuel ratio within a very short time from initiation of the feedback control, and the amplitude of variation of the air-fuel ratio after the desired value is obtained is not adversely influenced by this control operation. Accordingly, formation of $NO_x$ among pollutants of the exhaust gas when the engine condition is on the lean side of the stoichiometric air-fuel ratio can be remarkably reduced. By experiments, it has been confirmed that during a 10-mode driving test, formation of $NO_x$ emitted from the engine to which the present invention is applied is reduced by about 35 to about 40%. Furthermore, the apparatus of the present invention has the advantage that reduction of the operability of the engine owing to use of an EGR apparatus can be effectively prevented.

As many widely different embodiments of the present invention may be constructed without departing from the spirit and scope of the present invention, it should be understood that the present invention is not limited to the specific embodiments described in this specification, except as defined in the appended claims.

What is claimed is:

1. An air-fuel ratio feedback control apparatus of an internal combustion engine, said engine having at least one fuel injection valve disposed in an intake system thereof, an air-fuel ratio sensor disposed in an exhaust system thereof, and an open-loop fuel control means for providing said engine with an air-fuel mixture having an air-fuel ratio on the lean side of a desired air-fuel ratio, said apparatus comprising:

a closed-loop fuel control means for increasing or decreasing at a predetermined rate an amount of additional fuel fed into said engine via said fuel injection valve for enriching said lean air-fuel mixture, in accordance with the level of an air-fuel ratio condition signal from said air-fuel ratio sensor; and, an initial fuel control means for increasing the amount of additional fuel fed into said engine at a rate greater than the predetermined rate used in said closed-loop fuel control means, said initial fuel control means being operative only during a predetermined period following initiation of operation of said closed-loop fuel control means.

2. An air-fuel ratio feedback control apparatus as claimed in claim 1, wherein said initial fuel control means includes means for increasing the amount of fuel fed into said engine by increasing the amount of fuel injected from said fuel injection valve when operation of said closed-loop control means is initiated.

3. An air-fuel ratio feedback control apparatus as claimed in claim 2, wherein said initial fuel control means includes means for increasing the injecting period of at least the first injecting operation of said fuel injection valve when operation of said closed-loop control means is initiated.

4. An air-fuel ratio feedback control apparatus as claimed in claim 3, wherein said closed-loop fuel control means includes means for controlling the injecting period of said fuel injection valve by increasing or decreasing the length of injection time each time an injecting operation is carried out.

5. An air-fuel ratio feedback control apparatus as claimed in claim 4 wherein said injecting period control means comprises:

a first electrical means for generating an injection timing signal which indicates the starting time of an injecting operation of said fuel injection valve;

a second electrical means for increasing or decreasing the value of an output signal thereof by a certain value every time said injection timing signal is applied thereto; and, a third electrical means for generating a driving signal for energizing said fuel injection valve, said driving signal having a duration corresponding to the value of said output signal from said second electrical means.

6. An air-fuel ratio feedback control apparatus as claimed in claim 5, wherein said initial fuel control means comprises:

means for generating a feedback control instructing signal which indicates that said engine requires the starting of the air-fuel ratio feedback control operation; and, means for providing said second electrical means with an initial setting signal having a predetermined value larger than said certain value for increasing or decreasing the value of the output signal of said second electrical means before said feedback control instructing signal is applied.

7. An air-fuel ratio feedback control apparatus as claimed in claim 3, wherein said initial fuel control means includes means for increasing the injecting period of an injecting operation of said fuel injection valve from the initiation of operation of said closed-loop control means until the air-fuel ratio detected by said air-fuel ratio sensor becomes equal to a desired air-fuel ratio or is changed to the rich side of the desired air-fuel ratio.

8. An air-fuel ratio feedback control apparatus as claimed in claim 7, wherein said closed-loop fuel control means includes means for controlling the injecting period of said fuel injection valve by increasing or decreasing the length of injection time each time an injecting operation is carried out.

9. An air-fuel ratio feedback control apparatus as claimed in claim 8, wherein said injecting period control means comprises:

a first electrical means for generating an injection timing signal which indicates the starting time of an injecting operation of said fuel injection valve;

a second electrical means for increasing or decreasing the value of an output signal thereof by a certain value every time said injection timing signal is applied thereto; and, a third electrical means for generating a first driving signal for energizing said fuel injection valve, said first driving signal having a duration corresponding to the value of said output signal from said second electrical means.

10. An air-fuel ratio feedback control apparatus as claimed in claim 9, wherein said initial fuel control means comprises:

means for generating a feedback control instructing signal which indicates that said engine requires the operation of said closed-loop control means;

a fourth electrical means for generating a second driving signal for energizing said fuel injection valve, said second driving signal having a duration longer that the duration of said first driving signal; and, a fifth electrical means for selectively applying only said second driving signal to said fuel injection valve when said feedback control instructing signal is applied thereto, until the air-fuel ratio detected by said air-fuel ratio sensor becomes equal to the desired air-fuel ratio or is changed to the rich side of the desired air-fuel ratio.

11. An air-fuel ratio feedback control apparatus as claimed in claim 2, wherein said initial fuel control means includes means for increasing an injecting interval of the injecting operation of said fuel injection valve only when operation of said closed-loop control means is initiated.

12. An air-fuel ratio feed back control apparatus as claimed in claim 11, wherein said closed-loop fuel control means includes means for controlling the injecting period of said fuel injection valve by increasing or decreasing the length of injection time each time an injecting operation is carried out.

13. An air-fuel ratio feedback control apparatus as claimed in claim 12, wherein said injecting period control means comprises:

a first electrical means for generating a first injection timing signal which indicates the starting time of an injecting operation of said fuel injection valve;

a second electrical means for increasing or decreasing the value of an output signal thereof by a certain value every time said first injection timing signal is applied thereto; and, a third electrical means for generating a driving signal for energizing said fuel injection valve, said driving signal having a duration corresponding to the value of said output signal from said second electrical means.

14. An air-fuel ratio feedback control apparatus as claimed in claim 13, wherein said initial fuel control means comprises:

means for generating a feedback control instructing signal which indicates that said engine requires the starting of an air-fuel ratio feedback control operation;

a fourth electrical means for generating a second injection timing signal having a frequency higher than the frequency of said first injection timing signal generated by said first electrical means; and, a fifth electrical means for applying said second injection timing signal instead of said first injection timing signal to said second electrical means for a predetermined period of time when said feedback control instructing signal is applied thereto.

15. An air-fuel ratio feedback control apparatus as claimed in claim 20, wherein said engine has a carburetor in said intake system and said initial fuel control means includes means for providing said engine with a predetermined amount of additional fuel via said carburetor only when operation of said closed-loop control means is initiated.

16. An air-fuel ratio feedback control apparatus as claimed in claim 15, wherein said initial fuel control means includes means for generating a feedback control instructing signal which indicates that said engine requires the starting of an air-fuel ratio feedback control operation; and, means for providing said engine with fuel for a predetermined time period when said feedback control instructing signal is applied thereto.

17. An air-fuel ratio feedback control apparatus as claimed in claim 15, wherein said closed-loop fuel control means includes means for controlling the injecting period of said fuel injection valve by increasing or decreasing the length of injection time each time an injecting operation is carried out.

18. An air-fuel ratio feedback control apparatus as claimed in claim 17, wherein said injecting period control means comprises:

a first electrical means, for generating an injection timing signal which indicates the starting time of an injecting operation of said fuel injection valve;

a second electrical means for increasing or decreasing the value of an output signal thereof by a certain value every time said injection timing signal is applied thereto; and, a third electrical means for generating a driving signal for energizing said fuel injection valve, said driving signal having a duration corresponding to the value of said output signal from said second electrical means.

19. An air-fuel ratio feedback control apparatus as claimed in claim 6, 10, 14 or 16, wherein said engine has a throttle valve and said means for generating a feedback control instructing signal is composed of an engine operating condition sensor for detecting the condition where said throttle valve is opened wider than a predetermined degree.

20. An air-fuel ratio control apparatus for an engine comprising:

first fuel supply means for providing said engine with an air-fuel mixture having an air-fuel ratio on the lean side of a desired air-fuel ratio;

second fuel supply means comprising at least one injection valve disposed in the intake system of said engine for supplying additional fuel to said engine to enrich the lean air-fuel mixture provided by said first fuel supply means;

an air-fuel ratio sensor disposed in an exhaust system of said engine for providing an air-fuel ratio condition signal;

means responsive to an engine operating parameter for generating a feedback control initiation signal;

an injection valve control means rendered operative by said initiation signal for increasing or decreasing at a predetermined rate the amount of additional fuel fed into said engine by said injection valve in accordance with the level of said air-fuel ratio condition signal; and, an initial fuel control means responsive to said initiation signal for increasing the amount of additional fuel fed to said engine at a rate which is greater than the predetermined rate used in said injection valve control means, said initial fuel control means being operative only during a predetermined period following generation of said initiation signal.

* * * * *